United States Patent [19]

Roosa

[11] 4,163,521

[45] Aug. 7, 1979

[54] FUEL INJECTOR

[75] Inventor: Vernon D. Roosa, West Hartford, Conn.

[73] Assignee: Stanadyne, Inc., Windsor, Conn.

[21] Appl. No.: 854,663

[22] Filed: Nov. 25, 1977

[51] Int. Cl.[2] ..... F02M 55/00

[52] U.S. Cl. ..... 239/86; 239/533.3; 239/570

[58] Field of Search ..... 239/533.2–533.12, 239/86, 575

[56] References Cited

U.S. PATENT DOCUMENTS

| | | | |
|---|---|---|---|
| 3,255,974 | 6/1966 | Roosa | 239/533.6 |
| 3,342,422 | 9/1967 | Millington et al. | 239/533.5 |
| 3,477,648 | 11/1969 | Roosa | 239/533.7 X |
| 3,829,014 | 8/1974 | Davis et al. | 239/533.11 X |
| 3,924,583 | 12/1975 | Jardin | 239/533.11 X |

FOREIGN PATENT DOCUMENTS

| | | | |
|---|---|---|---|
| 552873 | 2/1958 | Canada | 239/533.5 |
| 1325754 | 8/1973 | United Kingdom | 239/533.11 |

*Primary Examiner*—Bruce H. Stoner, Jr.
*Assistant Examiner*—Andres Kashnikow
*Attorney, Agent, or Firm*—Prutzman, Kalb, Chilton & Alix

[57] ABSTRACT

A fuel injector for an internal combustion engine has an inlet member provided with an enlarged transverse opening which receives a tubular nozzle body having a peripheral shoulder to locate the inlet member longitudinally on the nozzle body. A shallow annular groove is formed around the periphery of the nozzle body in alignment with the fuel feed passage of the inlet member to provide a restricted annulus for delivering fuel to the interior of the nozzle body. The tubular nozzle body includes a plurality of inlet ports which communicate with the restricted annulus and are angularly spaced from the fuel feed passage so that the restricted annulus serves as a filter to remove solid particles entrained in the fuel. The inlet member is shrunk or press fit on the nozzle body without welding and a cap member provides a spring chamber to mount a spring which biases the valve against its seat and the inlet member against the shoulder. A non-threaded bushing is pressed into the end of the cap member to adjust spring pressure and a non-threaded lift stop is pressed into the bushing to adjust the lift of the nozzle valve. In an alternative, the valve guide is a removable bushing sealed to the nozzle body and retained therein by the bias of the cap member.

6 Claims, 3 Drawing Figures

FUEL INJECTOR

The present invention relates to a fuel injector for an internal combustion engine and, more particularly, to a fuel injector which incorporates an improved fuel inlet and nozzle support arrangement.

Fuel injectors of the type contemplated by this invention include a plunger or valve which is lifted from its valve seat by pressurized fuel delivered to the injector by an associated high pressure pump in measured charges and in timed relation with an associated engine. Such fuel injectors typically include a fuel inlet fitting coupled perpendicularly to the nozzle body to supply pressurized fuel to its valve chamber. Conventional inlet fittings are usually designed to project into a suitable inlet opening provided in the side wall of the nozzle and are welded in place to seal the inlet fitting to the nozzle body. Such welding has a harmful effect on the adjacent valve guide and restricts the design and manufacturing techniques used in the fabrication of the nozzle.

Moreover, the fuel supplied to the fuel injectors may include entrained solid particles which clog the nozzle discharge orifices and interfere with the desired fuel discharge. Thus, it is desirable to provide an internal filter arrangement which permits only the passage of particles of sufficiently small size to pass through the discharge orifices.

An object of the present invention is to provide a fuel injector including an improved fuel inlet fitting arrangement which is inexpensive to manufacture and assemble.

Another object of the invention is to provide an improved fuel injector which includes an internal filter which does not increase the size of the injector.

A further object is to provide an improved fuel injector which is easily assembled and disassembled for repair and maintenance.

The accompanying drawing illustrates a preferred embodiment of the invention and, together with the description, serves to explain the principles and operation of the invention.

Figure 1:
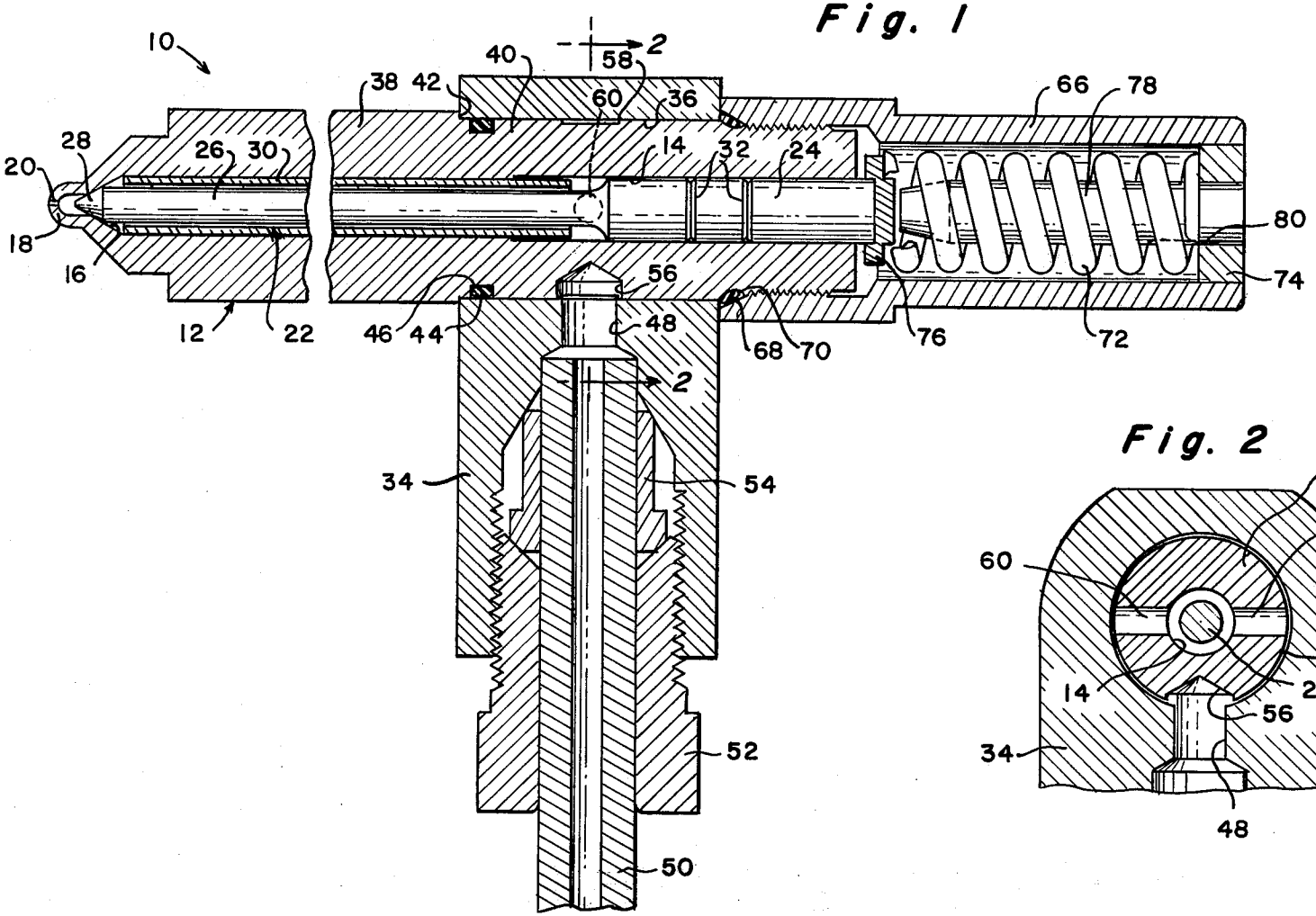
FIG. 1 is a fragmentary cross-sectional view of a fuel injector embodying the present invention.

Referring to FIG. 1, a fuel injector 10 includes an elongated tubular body 12 having a central bore 14 which forms a valve chamber. Tubular body 12 is shown as having a tapered or conical valve seat 16 located at one end of the valve chamber and formed on an integral discharge tip 18 of the tubular body. Discharge tip 18 includes at least one discharge orifice 20.

A rod-like plunger or valve 22 includes a rear cylindrical guide portion 24 slidably mounted in central bore 14 and a front stem portion 26 having a conical tip 28 which cooperates with valve seat 16 to control the discharge of fuel from the valve chamber through discharge orifice 20. A rearward portion of central bore 14 is finish lapped to receive cylindrical guide portion 24 of the valve to provide an integral valve guide.

A forward portion of central bore 14 which is slightly reduced in diameter receives an elongated cylindrical sleeve 30. A cylindrical sleeve 30 is provided in bore 14 to reduce the volume of the valve chamber to minimize the cushioning effect resulting from the slight compressibility of the fuel supplied to the nozzle under high pressure and to achieve uniformity in the successive fuel charges delivered by the nozzle to the engine. The sleeve thickness may be selected to maintain the pressure of the fuel within the valve chamber adjacent the valve seat at a high level when the valve is reseated after delivery of a fuel charge as more fully described and claimed in U.S. Pat. No. 3,876,152 entitled "Noncoking Fuel Injection Nozzle" and assigned to the same assignee as the present invention. Preferably, sleeve 30 comprises a spiral pin, i.e., a narrow strip spiraled into a cylindrical shape so that it closely and easily fits within bore 14, and is self-biased against the wall of the bore. Alternatively, the sleeve may be a length of strip material bent to form a cylindrical roll pin with a gap between its longitudinal edges.

A pair of longitudinally spaced peripheral grooves 32 is provided on cylindrical guide portion 24 of valve 22 to allow the valve to freely chatter, i.e., to reciprocate rapidly and frequently between an open and closed position during each injection. The function of peripheral grooves 32 is explained more fully in U.S. Pat. No. 3,722,801, entitled "Fuel Injector" and assigned to the same assignee as the present invention.

The fuel injector has an inlet fitting 34 having an enlarged circular opening 36 extending transversely therethrough and provides an interior cylindrical surface to receive tubular body 12. The tubular body has an enlarged diameter forward portion 38 and a reduced diameter rearward portion 40 which provide a peripheral shoulder 42 located at an intermediate position along the tubular body to locate the inlet fitting 34. Rearward portion 40 of the tubular body is received in circular opening 36 of inlet fitting 34 with an interference fit of, say, 0.0004" and is assembled by being shrunk or pressed thereon after these mating surfaces are finished lapped thereby to provide a seal therebetween. An O-ring 44 may be located in a peripheral groove 46 formed in the reduced diameter portion of tubular body 12 adjacent to shoulder 42 if desired, to guard against the leakage of any fuel which might bleed or weep between the surfaces of the inlet fitting and tubular body.

Tubular body 12 is provided with a blind hole 56 in alignment with fuel inlet passage 48. A shallow annular groove 58 is formed around the periphery of the tubular body in longitudinal alignment with blind hole 56. Peripheral groove 58 cooperates with the interior cylindrical surface of inlet member 34 to provide a restricted passageway for receiving fuel from fuel inlet passage 48. The depth of annular groove 58 is smaller than the diameter of discharge orifice 20 so that any entrained solid particles in incoming fuel which cannot pass through groove 58 are retained in blind hole 56.

Figure 2:
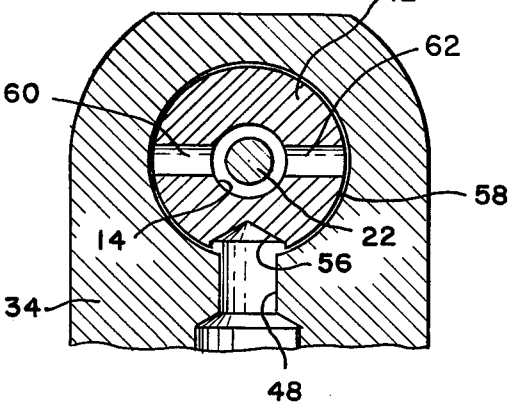
FIG. 2 is a fragmentary cross-sectional view taken along line 2—2 of FIG. 1; and, FIG. 3 is a view similar to FIG. 1 showing a modified form of the invention.

Referring to FIGS. 1 and 2, tubular body 12 is shown as having a plurality of inlet ports 60, 62 angularly spaced from fuel inlet passage 48 and blind hole 56. The inlet ports extend radially inward from annular groove 58 to central bore 14 to supply pressurized fuel from the inlet passage to the valve chamber. Preferably, and as shown in FIG. 2, inlet port 60 is spaced angularly by 90° from fuel inlet passage 48, while inlet port 62 is likewise angularly spaced by 90° in the opposite direction from the fuel inlet passage.

The restricted passageway provided by annular groove 58 serves as a filter for the fuel flowing from fuel inlet passage 48 to discharge tip 18. This internal filter, which does not require any additional space, prevents solid particles entrained in the fuel and of a size sufficient to clog the discharge orifices from entering the fuel chamber. Moreover, the pulsating action of the pressurized fuel supplied to the nozzle through inlet passages causes the solid particles to impact against the edges forming the entrance of annular groove 58 repeatedly with sufficient force to eventually break down the particles into smaller size which can pass through passage 58 into the valve chamber for discharge from orifice 20 so that the filter is self-cleaning.

Although, and as shown in the embodiment of FIG. 2, two inlet ports 60, 62 are provided in tubular body 12, it will be understood that a different number of inlet ports each angularly displaced from inlet passage 48 may be employed. For example, a single inlet port located diametrically opposite the radial blind hole 56 can be used. However, it is preferable that two inlet ports spaced angularly in opposite directions from fuel inlet passage 48 and blind hole 56 be used to direct the fuel via two paths along annular passage 58 into the valve chamber to double the capacity of the restricted passageway.

Referring to FIG. 1, a hollow cap 66 is threadably received on rearward portion 40 of tubular body 12. The end of cap member 66 engages one side of inlet member 34 to form a seal. If desired, an O-ring 68 may be received in annular notch 70 between tubular body 12 and cap 66 to insure a fuel tight seal between inlet member 34 and cap member 66. The cap also exerts a biasing force to maintain the inlet member against shoulder 42.

The outer cylindrical surface of tubular body 12 may be slightly tapered and the interior cylindrical surface of inlet member 34 similarly tapered to receive tubular body 12 with blind hole 56 and peripheral groove 58 in alignment with fuel inlet passage 48.

A coil spring 72 is located within cap member 66. The coil spring is interposed between an annular bushing 74 press fitted into the end of cap member 66 and a spring seat 76 which engages end 24 of valve 22. A cylindrical lift stop 78 press fitted into the central opening of bushing 74 extends within coil spring 72 toward spring seat 76. A small clearance gap is provided between spring seat 76 and lift stop 78 to fix the amount of lift of valve 22.

Valve 22 is normally biased toward valve seat 16 by coil spring 72 to maintain conical tip 28 of the valve in engagement with the conical surface of the valve seat to prevent fuel discharge through orifice 20. The compression of coil spring 72, and hence the opening pressure of valve 22, can be adjusted by pressing bushing 74 inwardly relative to cap member 66. Similarly, the lift of valve 22 can be adjusted by adjusting the relative position of lift stop 78 inwardly relative to bushing 74. When the desired lift and spring pressure are achieved, bushing 74 and lift stop 78 may be beam welded to prevent relative movement. A passage 80 may extend axially along the surface of lift stop 78 to provide a leakage path for any leak-off fuel which leaks past the valve 22 into the spring chamber.

Figure 3:
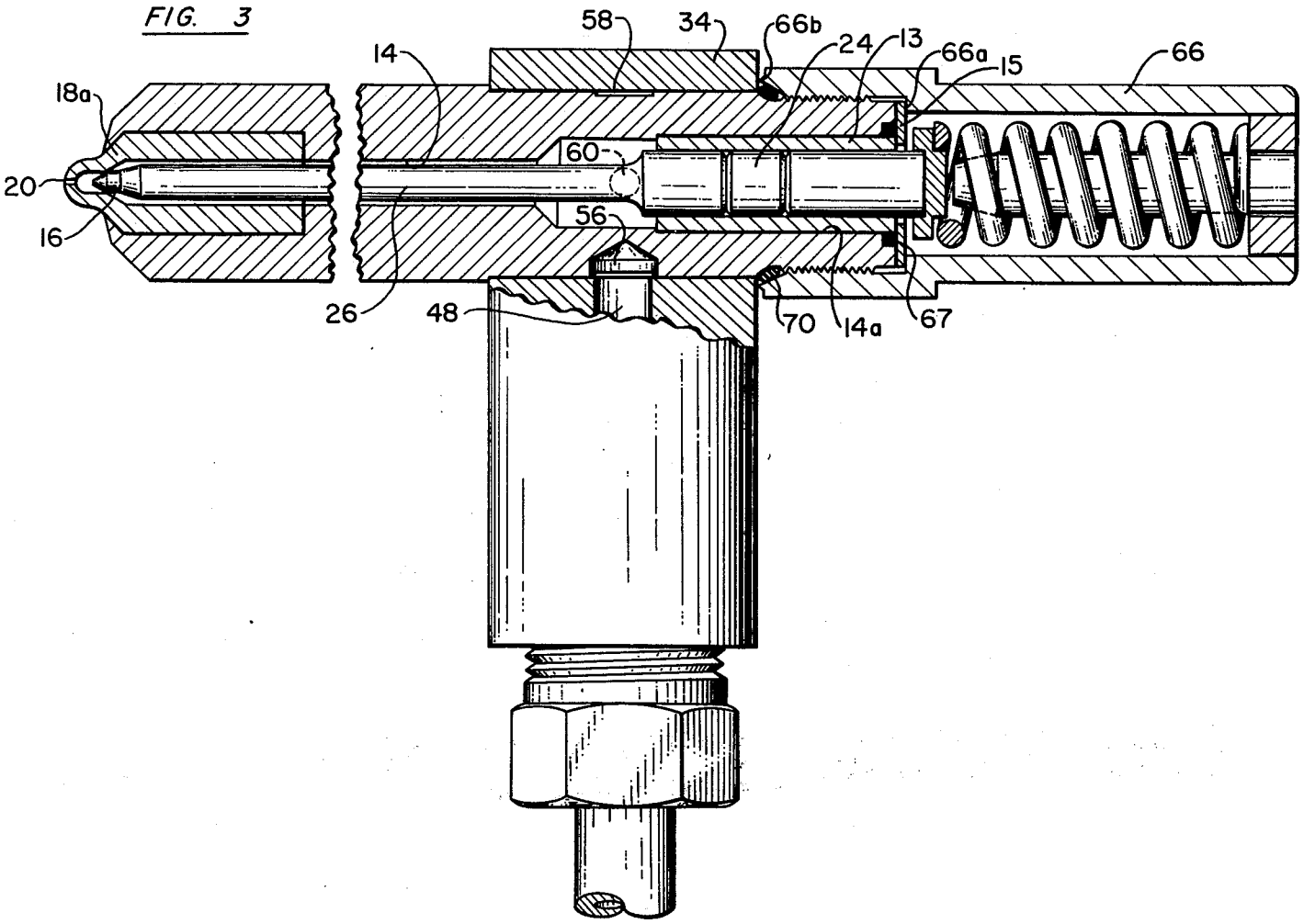

FIG. 3 illustrates a modified form of the invention wherein the nozzle body is provided with a separate valve guide bushing, and as shown, a separate valve seat. The valve tip **18*a* is inserted and retained in a cylindrical recess in the end of the valve body 38 in a conventional manner, and a valve guide sleeve 13 is preformed to final dimensions and slidably mounted in a cylindrical recess 14*a* finish lapped in the valve body. By virtue of the long sealing area between the guide sleeve and the mating surface of the recess 14*a***, very little leakage takes place. Thus, the sleeve may be lap finished to its final dimensions prior to assembly so that there is no distortion of the sleeve during assembly, as would occur if it were press fitted into place.

In order to secure the guide sleeve 13 in place against the high pressures in valve chamber 14, which may reach levels of 10,000 p.s.i., an annular washer 15 which overlies the outer end of the guide sleeve 13 is provided. Washer 15 in turn is held against the end of the valve body by a shoulder **66*a* of cap member 66. If desired, an O-ring 67 may be positioned in an annular recess at the end of the valve body to prevent any weepage of fuel which might otherwise take place between the guide sleeve 13 and the mating surface of recess 14*a*. The O-ring 67 will not be subject to the destructive repetitive high pressure pulses of pressure which take place in the valve chamber 14 due to the damping effect of the long weepage path along the guide sleeve. As shown, the end of the cap member 66 is provided with an annular ridge 66*b* which engages the inlet member 34. Such a ridge may be deformed slightly during assembly to accommodate any minor variations in the distances between the washer 15 and the inlet member 34** on different injectors.

From the foregoing, it is apparent that this invention provides an injector design wherein an integral heat-treated valve guide and valve seat may be utilized since no welding of the inlet member to the body is required. This provides flexibility in design alternatives and simplifies the manufacture of the nozzle. Moreover, the injector includes an integral filter which requires no space and the factory adjustments of valve lift and spring pressure are foolproof since they cannot be improperly adjusted in the field although the nozzle may be easily disassembled. In this regard, if the spring force decreases with age, shims may be added to restore the desired spring pressure.

The present invention is not limited to the specific details shown and described, and modifications may be made in the fuel injector without departing from the scope of the invention.

What is claimed is:

1. In a fuel injector for an internal combustion engine, said fuel injector having an elongated cylindrical body providing an axial bore forming a valve chamber having a valve seat and a discharge orifice at the forward end thereof, and inwardly opening pressure actuated valve in said bore for controlling the flow of fuel through said discharge orifice, and an inlet fitting for delivering pressurized fuel to said valve chamber, the improvement wherein said inlet fitting is provided with an enlarged circular opening surrounding said cylindrical body and engaging the same with a press fit, said cylindrical body and said inlet fitting defining a shallow peripheral groove therebetween, said groove having a depth which is less than the diameter of said discharge orifice, said inlet fitting further having an inlet passage communicating with said peripheral groove to accomodate the unrestricted flow of pressurized fuel thereto, and a port through the wall of said cylindrical body to provide communication between said peripheral groove and said valve chamber, said port being angularly displaced from said inlet passage to form a filter to prevent solid particles entrained in the incoming fuel from entering the valve chamber.

2. The device of claim 1 wherein said cylindrical body is provided with a pair of ports through the wall thereof to provide communication between said peripheral groove and said valve chamber, said ports being respectively angularly displaced from said inlet passage in opposite directions therefrom.

3. A device as recited in claim 1 wherein the said cylindrical body has an enlarged diameter forward portion and a reduced diameter rearward portion to form a peripheral shoulder, said reduced diameter rearward portion extending through and being surrounded by said inlet fitting, and a hollow cap member threadably engaged on said rearward portion in engagement with said inlet fitting to bias the same against said peripheral shoulder.

4. A device as recited in claim 3 wherein said cylindrical body and said inlet fitting further define an annular groove therebetween adjacent said peripheral shoulder and a resilient seal is mounted therein.

5. A device as recited in claim 4 wherein an annular seal is positioned between said hollow cap member and said inlet fitting.

6. A device as recited in claim 1 wherein a blind hole intersecting with said shallow peripheral groove is formed in said cylindrical body to provide a receptacle for the unfiltered solid particles entrained in the imcoming fuel.

* * * * *